United States Patent [19]

Ahroni

[11] Patent Number: 4,736,282

[45] Date of Patent: Apr. 5, 1988

[54] DECORATIVE LIGHT ASSEMBLY WITH TREE COLLAR

[76] Inventor: Joseph M. Ahroni, 2701 W. Manor Pl., #204, Seattle, Wash. 98199

[21] Appl. No.: 942,459

[22] Filed: Dec. 16, 1986

[51] Int. Cl.[4] ..... F21P 1/02

[52] U.S. Cl. ..... 362/123

[58] Field of Search ..... 339/157 R, 157 C; D11/118, 130; 428/65, 18, 19, 20; 362/122, 123, 237, 238, 249, 252, 419, 806; 439/650–654

[56] References Cited

U.S. PATENT DOCUMENTS

| | | | |
|---|---|---|---|
| 1,843,389 | 2/1932 | Fischer | 339/157 C |
| 2,047,045 | 7/1936 | Veenboer | 362/123 |
| 2,242,597 | 5/1941 | Quandee | 362/123 |
| 2,453,695 | 11/1948 | Belling | 362/123 |
| 3,723,723 | 3/1973 | Lerner | 428/18 |
| 3,770,951 | 11/1973 | Corelli et al. | 362/123 |
| 4,591,227 | 5/1986 | Colonna | 339/157 C |

*Primary Examiner*—Samuel Scott
*Assistant Examiner*—Noah Kamen
*Attorney, Agent, or Firm*—Seed and Berry

[57] ABSTRACT

A decorative light assembly for Christmas trees or the like wherein a collar adapted to be mounted on the tree trunk near the top of the tree has a light string draping therefrom in loops. The collar comprises a ring-shaped container with slots in its outer wall through which the light string passes to form unlighted retained loops inside the container and outside lighted loops draping from the container. A lid covers most of the length of the slots and is applied after the light string has been passed through the slots.

6 Claims, 3 Drawing Sheets

DECORATIVE LIGHT ASSEMBLY WITH TREE COLLAR

TECHNICAL FIELD

The present invention relates to display light sets for decorating Christmas trees or the like and means to assist evenly dispersing the lights.

BACKGROUND ART

In decorating Christmas trees, it is difficult to arrange the lights in a relatively evenly dispersed manner on and between the tree limbs, even if all of the lights are in one continuous string, as is possible in three-wire systems such as those in which groups of series-connected low-voltage lights are connected in parallel, as disclosed in my co-pending application, Ser. No. 664,153, filed Oct. 24, 1984, or in two-wire systems using a transformer for reduction from the line voltage or using 110–120 volt bulbs.

DISCLOSURE OF THE INVENTION

The aim of the present invention is to provide a light mounting system of simple and economical construction whereby a string of lights can be more easily arranged on a Christmas tree or the like.

In carrying out the present invention, a mounting collar is provided to surround the tree trunk near the top of the tree. This collar presents a circumferential row of mounting tabs or posts over which the wires of the light string can be hooked or looped at regular intervals to divide the light string into a series of depending loops. The tabs or posts are provided as protrusions in a ring-shaped holder comprising a covered container having ports in its bottom wall adjacent its periphery through which the light string wires extend. The outer sidewall of the container has loading slots open at the top and extending to the ports for introduction of the wires to the container, and these slots are covered by the container lid. The latter snap-fits over the container.

The lights in each loop can be evenly spaced apart, or varied in a pattern, or the spacing between the lights at the bottom of the loops can be increased to divide each loop into two lighted end sections draping downwardly from the mounting collar in diverging relation and an intermediate lighted or unlighted section located adjacent the bottom of the tree. The mounting collar can be provided as part of an ornament at the top of the tree.

BEST MODE FOR CARRYING OUT THE INVENTION

Figure 1:
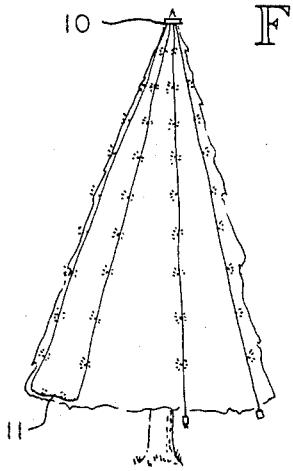
FIG. 1 is a perspective view illustrating a display light set (collar and light string) according to the present invention applied to a Christmas tree.

Referring to the drawings, it is seen that a mounting collar 10 is provided for use with a light string 11 which may be a single uninterrupted string of lights or may be formed by a series of light sets connected end-for-end into a continuous string. The bulbs 11*a* in the string may be of the plug-in or screw-in type mounted in sockets 11b and preferably are "miniature style," low-voltage lights of 12 volts or less. The wires electrically connecting the light sockets 11b may be independent insulated conductors or separated by insulation in a single cord. A suitable light string is disclosed in my co-pending application Ser. No. 664,153, filed Oct. 24, 1984, which is a three-wire set in which the wires (conductors) are in a single cord and connect the lights in a series-parallel arrangement, i.e., groups of lights in series are connected in parallel. Another suitable string is one or more of the type having, for example, 100 lights per set connected in a series-parallel arrangement with three insulated conductors twisted together and having an attachment plug at one end and an end connector at the other end so that two or more of the sets can be connected end-for-end. In such a string, normally one of the three conductors deadends within the attachment plug and another one of them deadends within the end connector. Long two-wire light sets are also suitable for the practice of this invention if the bulbs have a 110–120 volt rating or a transformer is utilized in conjunction with the power supply to the set.

In view of the foregoing, for purposes of this description and accompanying claims, the word "string" includes two or more sets connected end-for-end, as well as a single set, and the word "cord" means insulated wires which may be twisted together, as well as meaning more than one conductor encased in a single insulating shield.

The mounting collar 10 preferably takes the form of a ring-shaped container 12 having a lid 14. The container 12 has a flat annular bottom wall 12*a*, a circular inner wall 12*b*, and curved outer sidewall elements 12*c* separated by vertical slots 15. These slots 15 extend for the full height of the container 12 from the upper rim thereof through the periphery of the bottom wall 12*a*.

Figure 7:
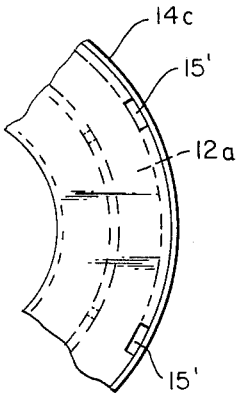
FIG. 7 is a fragmentary bottom plan view showing the container and lid of the collar assembled without a light string.

The lid 14 has a flat upper wall 14*a* with a center opening 14*b* corresponding in diameter with that of the inner face of the container inner wall 12*b*. At its periphery, the lid 14 has an annular skirt wall 14*c* covering the sidewall elements 12*c* and slots 15 therebetween and extending flush with the bottom face of the container 12. Hence the only visible part of the slots 15 when the lid 14 is in container-covering position is the extreme lower end thereof, as viewed from the underside of the container 12. When so viewed, as shown in FIG. 7, the lower ends of the slots comprise ports 15*d*'.

Figure 5:
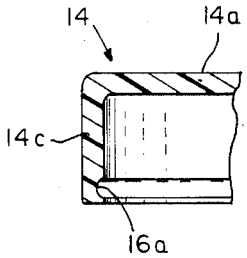
FIG. 5 is a detail vertical sectional view taken along line 5—5 in FIG. 3.
Figure 6:
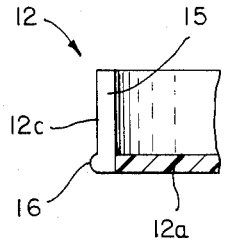
FIG. 6 is a detail vertical sectional view taken along line 6—6 in FIG. 3.

For ease of assembly, it is preferred to have the lid 14 and container 12 snap-fit together. This is accomplished by forming the container 12 with external locking ribs 16 (FIG. 6) adjacent the juncture of the bottom wall 12*a* and the outer sidewall elements 12c, and forming the skirt wall 14c of the lid 14 with a complementary circumferential inside keeper groove 16a (FIG. 5) adjacent the lower edge thereof. The parts of the mounting collar are preferably plastic and formed by injection molding whereby there is sufficient resiliency of the parts to permit the lid 14 to snap-fit by its groove 16a over the locking ribs 16. It is preferred to have each locking rib 16 extend substantially the length of the respective outer sidewall element 12c between the slots 12d, although this is not essential.

Figure 3:
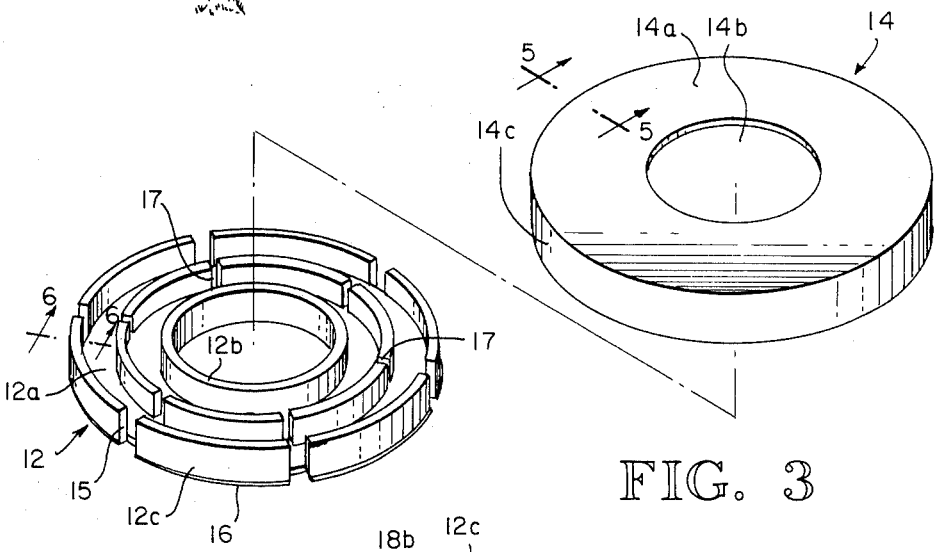
FIG. 3 is an exploded perspective view of the container and lid, and lid components of the collar.
Figure 8:
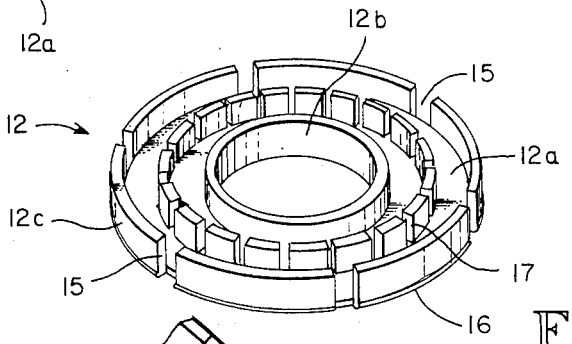
FIG. 8 is a fragmentary perspective view illustrating a modified container element of the collar.

Within the container 12 there is preferably provided a series of integral upstanding tabs or posts 16 arranged in a circle and separated by inner slots 17. Two post embodiments have been shown, one (FIG. 3) having a single post 16 located radially opposite each outer sidewall element 12c, and the second (FIG. 8) having sets of three posts 16a located radially opposite each outer sidewall element 12c. The posts 16a in each set are separated by slots 17a like the slots 17 separating the sets. Preferably, the slots 17, 17a are narrower than the slots 15 when the light set to be used with the mounting collar has a cord 18 of the type with multiple wire leads encased in a single flexible insulating shield, such as the cord 18, for example, which has three side-by-side leads 18a separated and shielded by insulation 18b. In this example, the cord has a width approximately three times its thickness; hence, the widths of the outer slots 15 are preferably made approximately three times the width of the inner slots 17, 17a and slightly less than the width of the cord 18. With this arrangement, the cord 18 will fit snugly in an outer slot 15 with its width horizontally across the slot, and will also fit snugly in an inner slot 17 or 17a with the width of the cord extending vertically. It will be appreciated that the inside height of the container 12 need be only as great as the maximum dimension of the cord 18 to be used.

Figure 4:
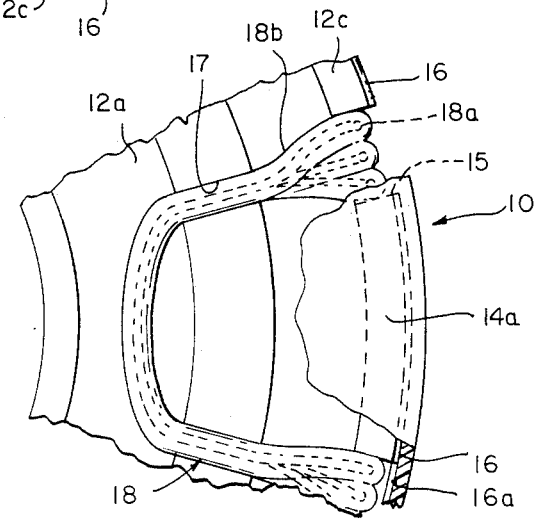
FIG. 4 is a fragmentary top plan view to an enlarged scale with the lid broken away, showing a light string assembled with the collar.
Figure 9:
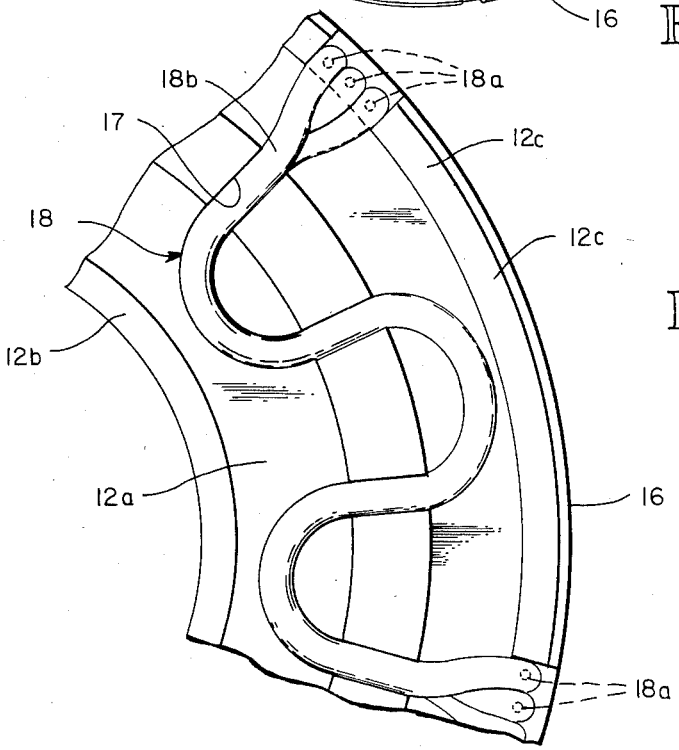
FIG. 9 is a view taken as in FIG. 4, but with the modified container element and the lid.

When the light string 11 is to be assembled with the collar 10, the container 12 is loaded with the cord 18 with the lid 14 removed. The cord 18 of the string is inserted through the open upper end of the slots 15 and 17 and looped around the posts 16, as shown in FIG. 4. In the case of the second embodiment with sets of posts 16a, the cord is preferably snaked between the posts 16a, as shown in FIG. 9. When the wires are contained side-by-side in a flat cord 18 as shown, preferably the cord is positioned so that one of the flat sides (wider sides) faces the bottom wall 12a of the container at the entry of the cord into the slots 15, and the cord is twisted a quarter turn so that the wider sides of the cord are vertical where the cord passes through the inner slots 17. In this regard, as previously indicated, it is preferred to make the width of the slots 15 and 17 such that the cord 18 will fit snugly therein.

For purposes of example, the collar 10 has been shown formed with six ports 15. In this case, the light string has three anchor loops without lights in the ports and two loop sections 11A–11B outside of the collar 10. It also has two end segments 11C and 11D to the plug 20 and end connector 21 (if provided) which jointly provide a third section complementing loop sections 11A–11B.

Figure 2:
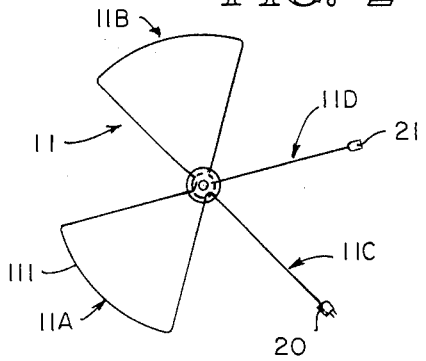
FIG. 2 is a top schematic view showing the light set as arranged on the tree.
Figure 10:
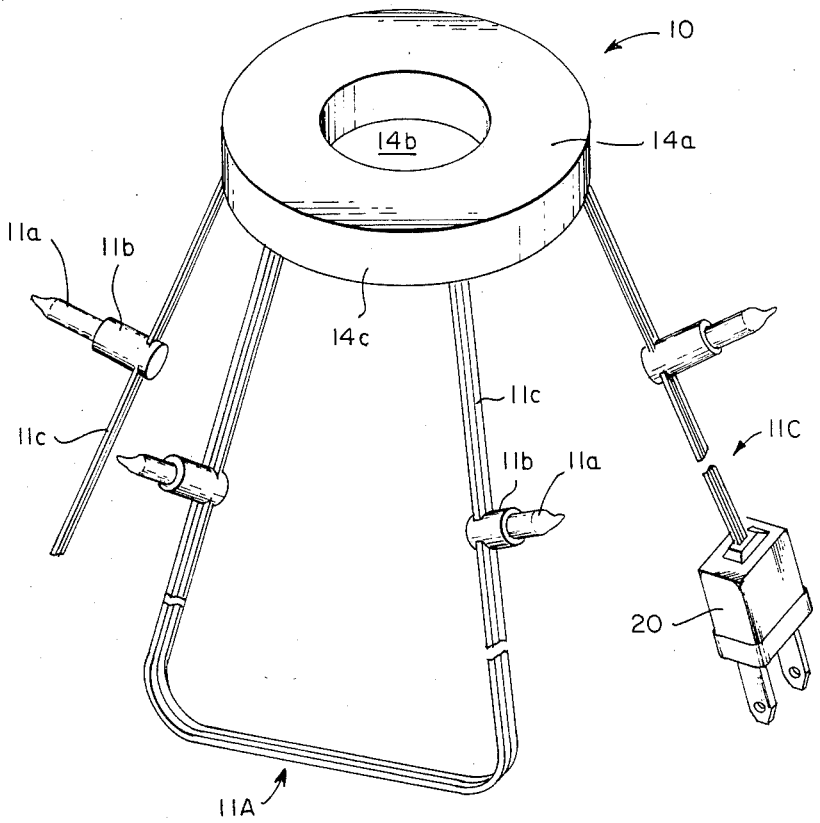
FIG. 10 is a closeup view of the display light set.

When the light string 11 is to be used, the collar is placed over the top of the tree and the two loop sections 11A, 11B and end sections 11C, 11D of the string can be conveniently draped, as shown generally in Figures 1, 2, and 10. This draping can be done in a zig-zag path down the tree, or in any other suitable manner, and the bottom segment of each loop (marked 111 in FIG. 2 for loop section 11A, for example) may be veed upwardly or downwardly on the tree or placed horizontally. In this regard, the light string may be manufactured with groups of regularly spaced sockets which are separated by unsocketed cord segments longer than the regular spacing between the sockets. These unsocketed cord segments then become the bottom segments 111 of the draped loops 11A–11B. As a further alternative, the bottom segments 111 can be provided, for example, with one or more sockets spaced at different intervals. It will also be understood that instead of having the string 11 arranged in the collar 10 so that the upper sockets in the loop sections are equidistant from the collar, the string can be arranged so that the sockets 11b at the upper ends of each loop section are at different spacings from the collar.

Although it is preferred to provide posts 16 within the container 12, such are not essential for operation of the invention since the cord sections within the container can extend directly from one slot 15 to the next rather than via a post or posts. If posts are not used, it is particularly advantageous to have the cord fit snugly in the bottom of the slots 15. The number of slots 15 and 17 can be varied for different heights and girths of trees, and extra slots can be provided.

The collar 10 can be incorporated as part of a top ornament for the tree. Hence, the word "collar," as used in the annexed claims, is intended to include a part of a head ornament or the like.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A collar for holding a string of lights on a tree with the collar around the tree trunk near the top of the tree and the string draping from the collar, said collar comprising:

a ring-shaped container having an annular bottom wall and a plurality of upstanding outer wall sections connected to the bottom wall and separated by vertical slots which are open at the top for insertion of segments of a light string and intersect the bottom wall at ports;

a lid with a top annular wall overlying said bottom wall in spaced relation thereto and having an outer wall externally covering said wall sections and slots such as to leave said ports exposed at the bottom of said bottom wall for passage therethrough of a light string arranged with anchor loop segments thereof without lights in the container which alternate with loop segments thereof with lights outside the container; and said container also having ports therein which are upstanding from said bottom wall and are located inwardly of said outer wall sections so as to be arranged to be engaged by the anchor loop segments of the light string located in the container.

2. A collar according to claim 1 in which said container has an upstanding inner wall engaged at the top by the top annular wall of the lid.

3. A light string and mounting collar assembly, comprising:

a light string having a cord, a mounting collar having a holder and a retainer, said holder being formed with a base wall having a central opening for receiving the trunk of a tree therethrough, and having peripheral side wall sections projecting upwardly therefrom which are separated from one another by slots open at the upper projecting end of the side wall sections for insertion of said cord;

said retainer covering said base wall in spaced relation thereto and having a skirt which overlaps said side wall sections and covers said slots except for a bottom portion thereof;

said cord being arranged with retained loop sections thereof located between said base wall and retainer, and said cord passing through said bottom portion of said slots to outside loop sections thereof which alternate with the retained loop sections and are free to be draped relative to said mounting collar when the mounting collar is mounted around a tree trunk.

4. An assembly according to claim 3 in which said slots extend through the periphery of the base wall to provide ports through which said cord passes between its outside loop sections and retained loop sections.

5. An assembly according to claim 4 in which said cord has side-by-side wire conductors spaced apart across its width in an insulating shield arranged with the width of the cord extending across the width of said slots, said cord having a quarter-turn twist at each end of each retained loop section.

6. An assembly according to claim 5 in which each retained loop section passes part way around a respective post upstanding from said base wall.

* * * * *